United States Patent [19]

Uyeda

[11] 4,418,555

[45] Dec. 6, 1983

[54] CYLINDER TYPE LOCK AND KEY

[75] Inventor: Tim M. Uyeda, South San Gabriel, Calif.

[73] Assignee: La Gard, Inc., Torrance, Calif.

[21] Appl. No.: 346,131

[22] Filed: Feb. 5, 1982

[51] Int. Cl.[3] ..... E05B 29/02

[52] U.S. Cl. ..... 70/366; 70/377; 70/409; 70/411; 70/324

[58] Field of Search ..... 70/364 R, 365, 366, 70/376, 377, 411, 409, 323, 324, 326

[56] References Cited

U.S. PATENT DOCUMENTS

| | | | |
|---|---|---|---|
| 1,228,445 | 5/1917 | Janes . | |
| 2,356,891 | 8/1944 | Seiffert | 70/411 |
| 3,367,156 | 2/1968 | Johnstone . | |
| 3,668,909 | 6/1972 | Roberts | 70/411 |
| 3,848,442 | 11/1974 | Mertanen . | |
| 4,008,588 | 2/1977 | Miller | 70/366 |
| 4,062,211 | 12/1977 | Miller . | |
| 4,083,212 | 4/1978 | Proefrock | 70/366 |
| 4,359,885 | 11/1982 | Goldman . | |
| 4,375,159 | 3/1983 | Bechtiger . | |

FOREIGN PATENT DOCUMENTS 891514 9/1953 Fed. Rep. of Germany ..... 70/366

*Primary Examiner*—Robert L. Wolfe

*Attorney, Agent, or Firm*—Poms, Smith, Lande & Rose

[57] ABSTRACT

A cylindrical type lock has a rotatable cylinder within a lock body wherein the cylinder has a stacked array of a plurality of nested and alternating tumbler wheels and spacer discs mounted in a subassembly with the cylinder to the lock body, the spacer discs are held stationary by tab projections which extend radially outwardly into a longitudinal groove in the cylinder into which they slip fit on assembly along with the tumbler wheels in stacked array into the cylinder, the wheels and discs being formed with identical annular projections on one side and mating annular recesses on opposite sides so that the wheels and discs nest in interfitting relation in the stacked array within the cylinder to be operated by an associated key which has a plurality of spaced segmented disc-like coded webs and blank webs which are adapted to align with the tumbler wheels and spacer discs respectively when the key is inserted into the lock and rotated.

8 Claims, 16 Drawing Figures

CYLINDER TYPE LOCK AND KEY

BACKGROUND OF THE INVENTION

The present invention relates in general to cylindrical type locks and keys and more particular to the so called plug type cylinder lock wherein a generally round key shank is inserted into a cylindrical bore of a plurality of tumbler wheels rotatably mounted within the cylindrical lock.

Various types of cylindrical type locks have been made heretofore wherein a manually operable dial member or key is manipulated to rotate the tumbler members within the lock to align tumbler wheel gates with a fence member in order to allow opening of the lock. Most of these prior locks have been complicated to manufacture, require many separate lock parts which require intricate assembly operations and in general have not been as entirely satisfactory as I perceive a cylindrical type lock should be in order to operate effectively while being relatively simple to assemble and inexpensive to produce.

SUMMARY OF THE INVENTION

It is therefore the primary object of the present invention to disclose and provide a cylinder type lock and key wherein a plurality of tumbler wheels may be formed and assembled in a simple manner to provide an effectively operating lock which will provide the pick proof characteristics and manufacturing simplicity required to product a widely acceptable and inexpensively manufactured lock and key product. It is a further object to provide such a lock and key arrangement wherein the lock parts may be provided in subassemblies which are simply stacked together and then simply and securely fitted in operable position within the associated lock body.

Generally stated, the present invention in a cylindrical type lock having a rotatable cylinder within a lock body, the cylinder having a plurality of gated tumbler wheels rotatable therein and a fence member interpose between the cylinder and body to prevent relative rotation of the cylinder and body unless the tumbler wheels are properly aligned by an associated key to allow reception of the fence member into the tumbler wheel gates, contemplates the provision of a stacked array of a plurality of nested tumbler wheels and spacer discs in an alternating repetition of wheels and discs and specifically wherein the wheels and discs are each provided with identically configured annular projections on one side and annular recesses on an opposite side such that the projections of the wheels and discs are received in the adjacent recess of the adjacent wheel or disc so that the wheels and discs have an interfitting nested relationship.

More specifically, the present invention contemplates the provision of a stacked array of nested tumbler wheels and spacer discs as described wherein the wheels and discs may be simply stacked in alternating fashion into a stack thereof which is then slip fit into a cylinder, the spacer disc having projecting stop tabs which slip into an annular groove in the cylinder to thereby hold the spacer disc stationary while the nested tumbler wheels are free to be rotated through engagement between an inserted key and radially inwardly extending projections on the tumbler wheels. An end disc is axially movable in the cylinder and biased toward the array to maintain a nested array of tumbler wheels and spacer discs, which are otherwise loosely stacked in assembled operative relation interfitted with one another. The subassembly of tumbler wheels, spacer discs, the end biased assembly disc and cylinder are then simply assemblable as a unit into the lock body and held therein by an appropriate snap ring fitted into a snap ring receiving groove internally of the lock body.

A key member of generally cylindrical shank configuration is provided with a series of spaced alternating coded and blank webs with a top guide groove to facilitate initial alignment of the key shank within the lock body. The blank webs merely ride within fully open bores within the spacer discs while the coded webs selective abut radially inwardly extending projections provided on the tumbler wheels. The coded webs are selectively formed to cause predetermined extent of rotation for an aligned tumbler wheel when the key is rotated such that on alignment of the tumbler wheel gates to an associated fence member, the cylinder may be rotated within the lock body to open the associated bolt mechanism with which the lock may be employed. It is believed that a better understanding of the present invention, as well as an appreciation of additional objects and advantages thereof, will be afforded to those skilled in the art from a consideration of the following detailed description of a preferred exemplary embodiment thereof. Reference will be made to the appended drawings which will first be briefly described.

DETAILED DESCRIPTION OF THE PREFERRED EXEMPLARY EMBODIMENT

Figure 1:
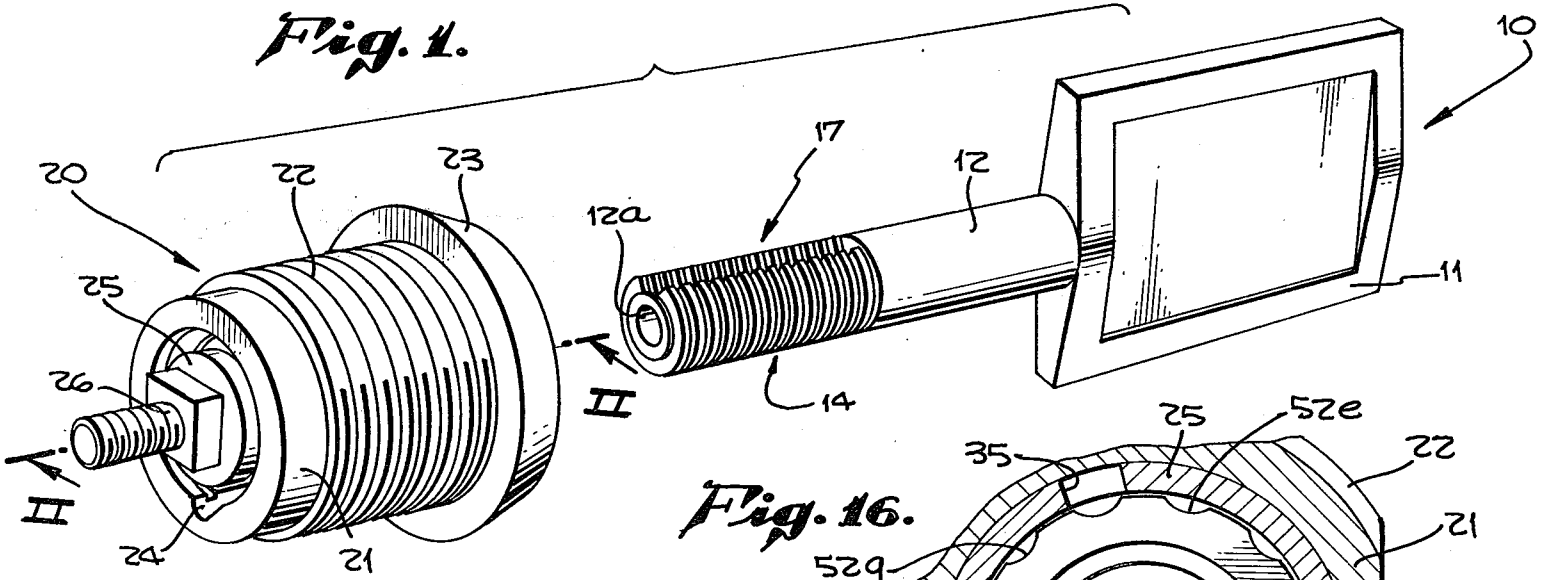
FIG. 1 is a perspective view of a preferred exemplary embodiment of cylindrical lock and key, in accordance with the present invention, the key shank being illustrated in blank or non-coded configuration.
Figure 16:
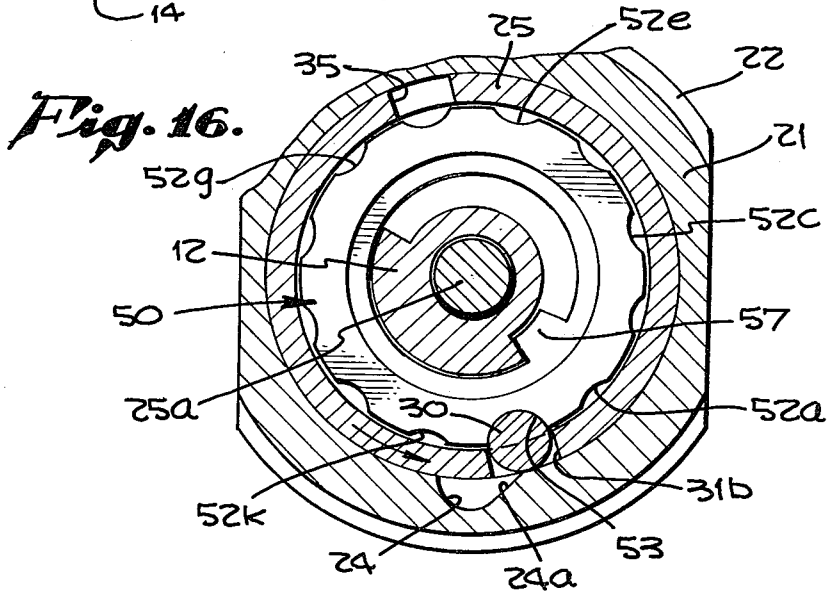
FIG. 16 is a detail view of the lock portions of FIG. 5 showing the fence pin in the alternate position.

Referring initially to FIG. 1, a preferred exemplary embodiment of cylindrical type lock and key, in accordance with the present invention, will be now explained in detail. The exemplary key blank is indicated generally at 10 in FIG. 1 and has a shank 12 which is provided with a shank bore 12a. As seen at the right hand end of shank 12, a suitable handle or hilt 11 may be provided on the left hand end of shank 12, is seen in FIG. 1, a plurality of blank annular disc like webs, indicated generally at 14, are provided with a longitudinally extending guide slot, indicated generally at 17, extending along upper portions thereof to guide the shank entry to the lock body as will be explained more fully hereinafter.

Figure 2:
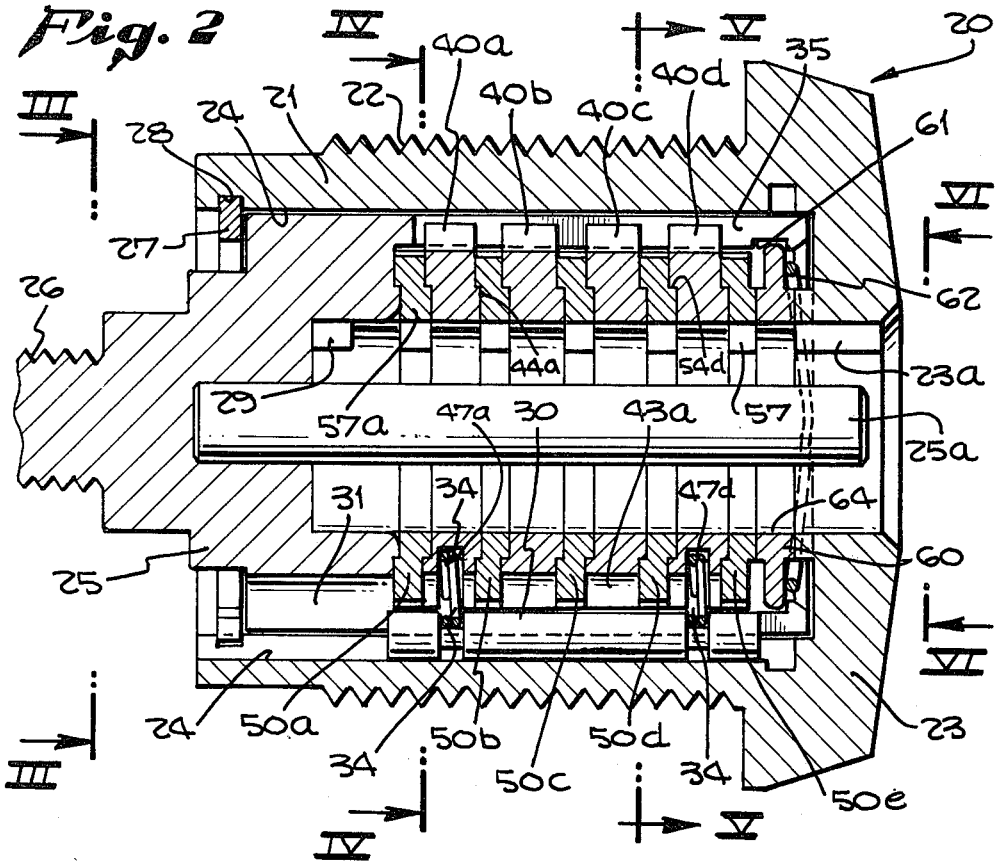
FIG. 2 is a section view through the cylinder lock of FIG. 1 taken therein along the plane II—II.
Figure 9:
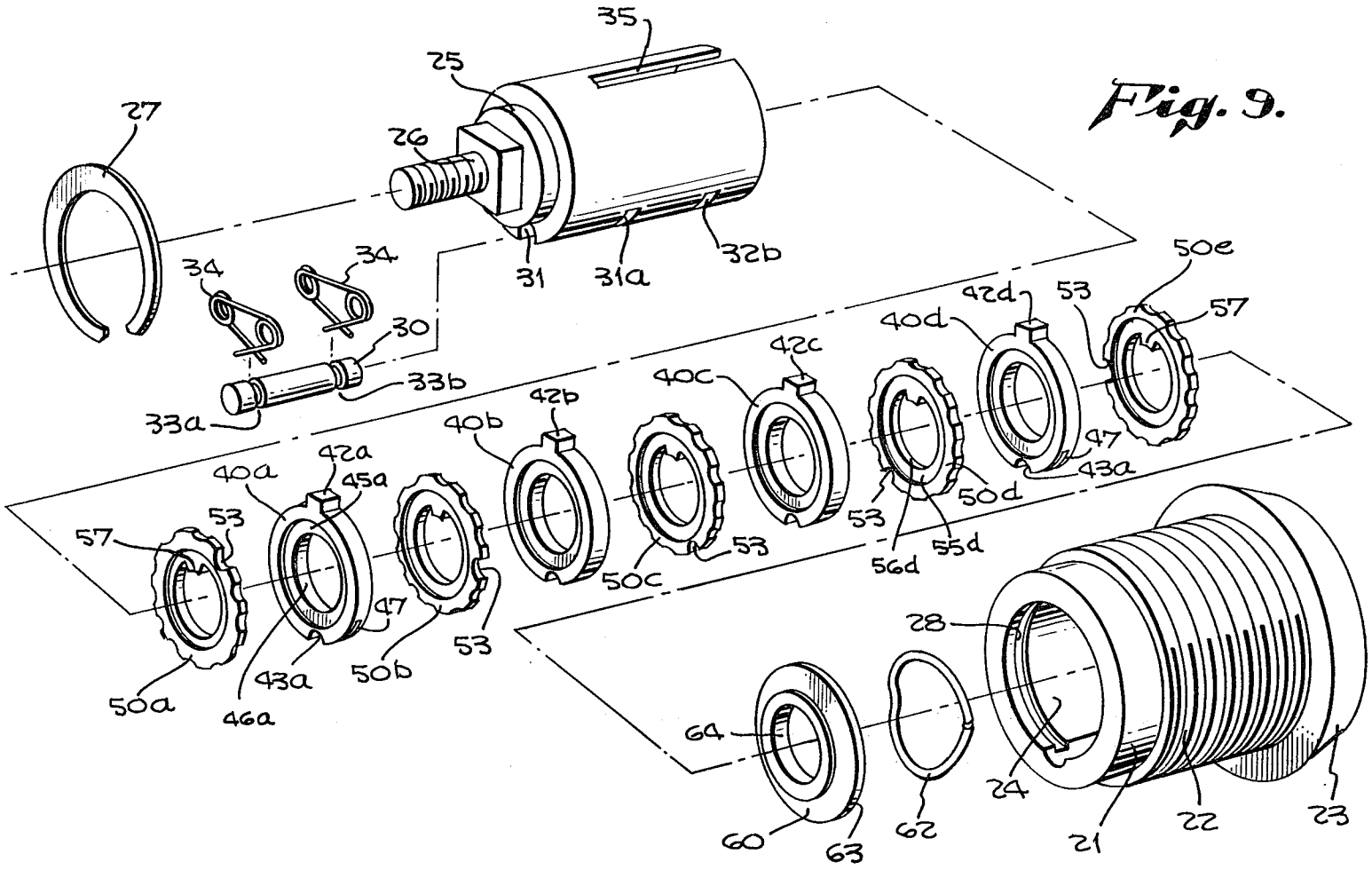
FIG. 9 is an exploded perspective view of the exemplary embodiment of cylindrical type lock and key of the present invention and of FIGS. 1 through 8.
Figure 10:
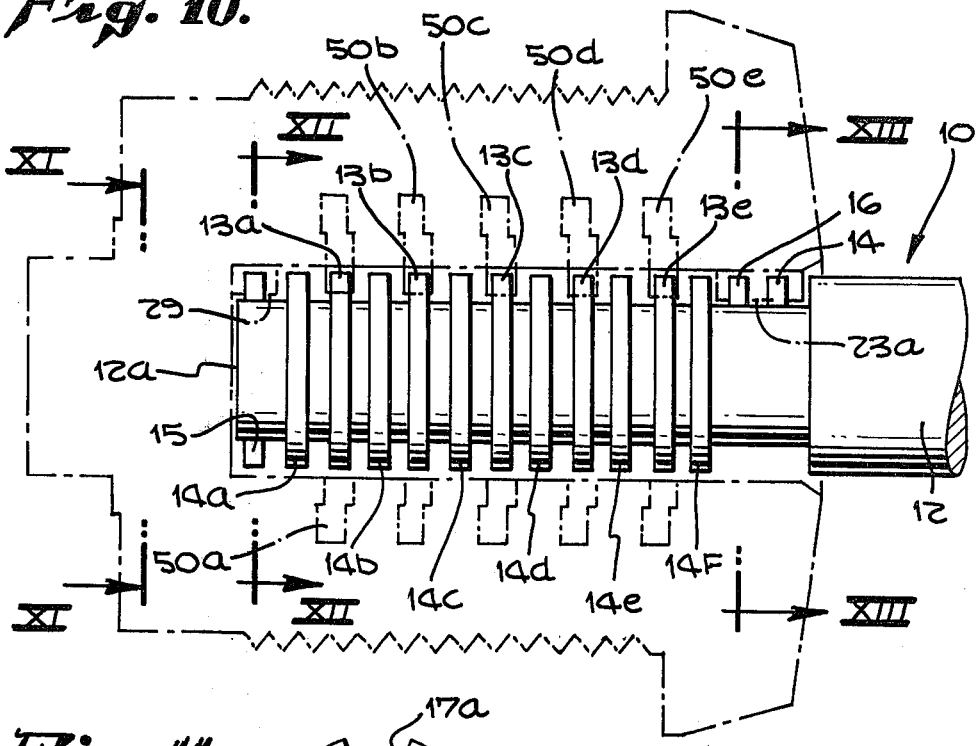
FIG. 10 is a side view of the blank key shank of FIG. 1 shown inserted into the cylindrical type lock of the present invention illustrated in dotted line.
Figure 11:
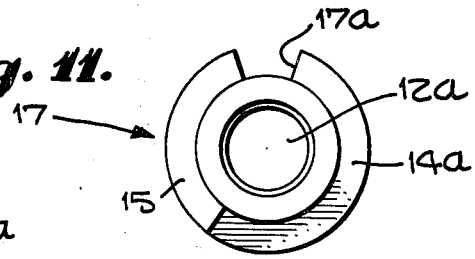
FIG. 11 is an end view of the shank of FIG. 10 taken therein along the plane XI—XI.
Figure 12:
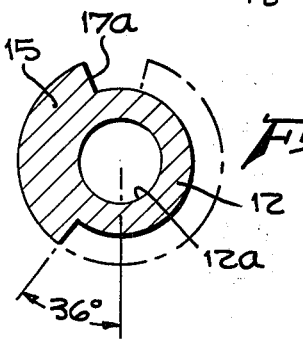
FIG. 12 is a section view through the key shank of FIG. 10 taken therein along the plane XII—XII.

The exemplary cylindrical type lock, in accordance with the present invention, is indicated generally at 20 in FIG. 1 and includes a body 21 of generally cylindrical configuration having external threads 22 for mounting the lock in a safe door, or the like; with the lock nose or face 23 protruding forwardly of the safe door. The lock body has a bore 24 which receives a rotatable cylinder 25, the latter being best seen in FIGS. 2 and 9. Cylinder 25 has a key shank guide post 25*a*. A threaded stud 26 is provided on a rear portion of cylinder 25 to cooperate with a latch actuating member associated with the safe to which the lock is assembled. As best seen in FIG. 2, a snap ring 27 is provided to fit within an interior annular snap ring receiving groove 28 provided in body 21 to hold the cylinder within the body. A drive lug 29 is formed interiorly of the cylinder to cooperate with an end driver web 15, as seen in FIGS. 10 through 12, on the key shank 12.

Figure 15:
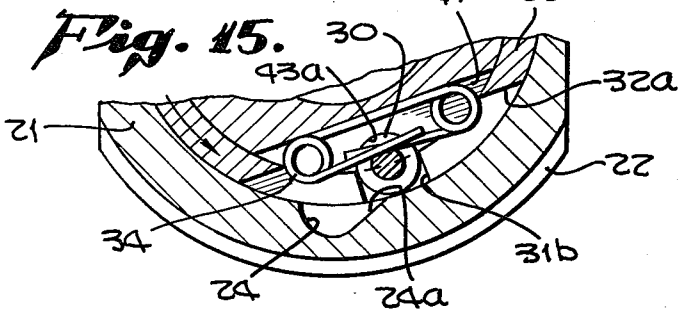
FIG. 15 is a detail view of the lock portions of FIG. 4 showing the fence pin in an alternate position.
Figure 3:
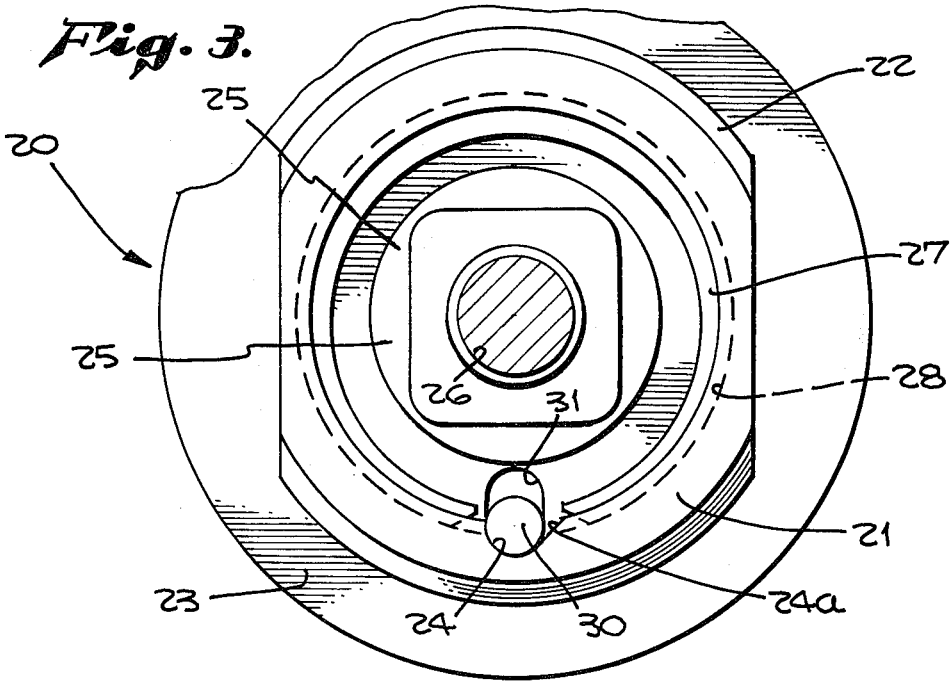
FIG. 3 is a rear end view of the cylinder lock of FIG. 2 taken therein along the plane III—III.
Figure 4:
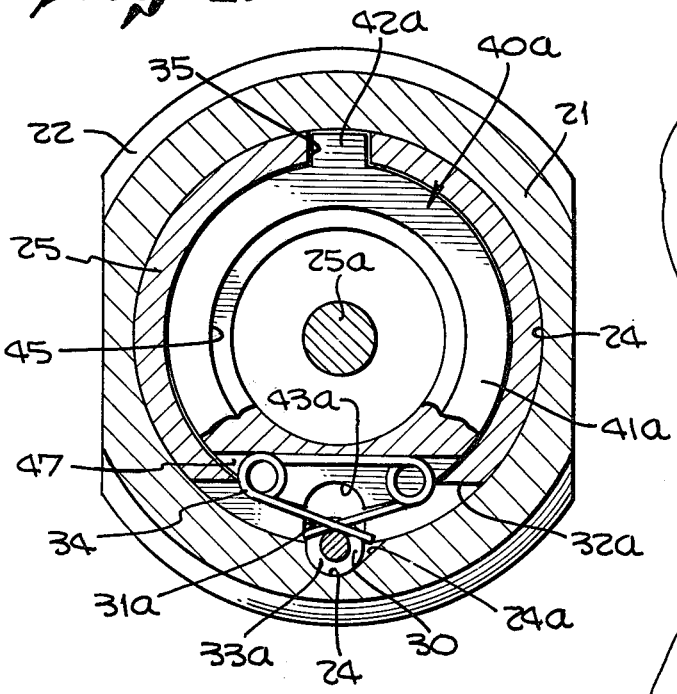
FIG. 4 is a section view of the cylinder lock of FIG. 2 taken therein along the plane IV—IV.
Figure 6:
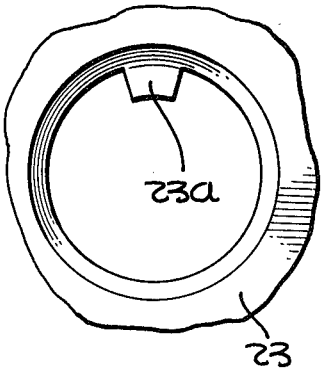
FIG. 6 is a detail front view of the cylinder lock of FIG. 2 taken therein along the plane VI—VI.

Rotation between cylinder 25 and lock body 21 is normally prevented by virtue of the provision of a fence member 30 which comprises a pin like configuration in the exemplary embodiment. Cylinder 25 is provided with an longitudinal slot 31, as best seen in FIGS. 2, 3 and 9, receiving fence member 30 for movement therein, member 30 being normally biased outwardly by the two fence springs 34. Channel 31 has spring slots 31*a* and 31*b* while fence member 30 has spring grooves 33*a* and 33*b*. As best seen in FIGS. 4 and 15, springs 34 cooperate with fence member 30 in biasing in outwardly of the cylinder to act in conjunction with the tumbler wheels as discussed hereinafter. Cylinder 25 further is provided with a top longitudinal slot 35, as seen in FIG. 9, for receiving portions of the specer discs on there assembly to the cylinder 25 as discussed hereinafter.

As in particularly contemplated within the present invention, a stacked array of a plurality of nested and alternating tumbler wheels and spacer discs are provided in a preassembly with the cylinder 25 which is easily assembled to the lock body 21. The spacer wheels 40 are best seen in FIGS. 2 and 9 include, in the exemplary embodiment, four separate spacer wheels or discs 40*a*, 40*b*, 40*c*, and 40*d*. Each of the spacer discs 40 include an annular body such as 41*a* in FIG. 4, a stop tab projecting radially outwardly of an upper portion thereof such as tab 42*a* in FIG. 4, a fence receiving notch such as notch 43*a* in FIG. 4, a front annular boss or projection such as projection 44*a* in FIG. 2, a rear annular recess such as recess 45*a* as seen in FIG. 9 and a central bore such as bore 46*a* in FIG. 9. Two of the spacer discs, 40*a* and 40*d*, are provided with spring receiving slots 47*a* and 47*d*, respectively as best seen in FIG. 2. When the spacer discs and tumbler wheels 50 are placed in stacked and nested relation, and assembled to cylinder 25, the spacer disc stop tabs 42*a*–42*d* slip fit into longitudinal groove 35 in order to be held stationary within cylinder 25 during operation of the lock as discussed hereinafter.

Figure 5:
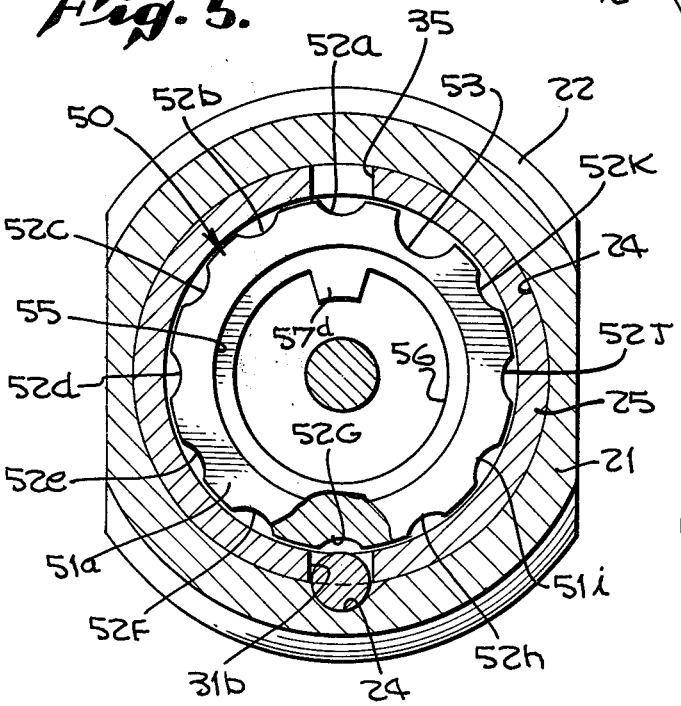
FIG. 5 is a section view of the cylinder lock of FIG. 2 taken therein along the plane V—V.
Figure 7:
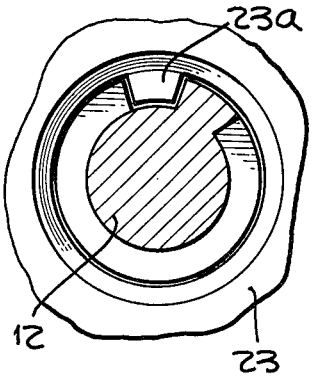
FIG. 7 is a view as in FIG. 6 showing a portion of the key shank inserted therein.

A plurality of tumbler wheels 50 are provided in the stacked array of wheels and discs as seen in FIG. 2. In the exemplary embodiment, and as seen in FIGS. 2 and 9, five tumbler wheels 50*a* through 50*e* are provided with each of the wheels 50 having an annular body such as body 51*a* in FIG. 5, a plurality of false gates 52*a* through 52*k* as seen in FIG. 5, a single true gate such as gate 53 in FIG. 5, a front annular boss or projection identical to the projection on the spacer dics, such as projection 54*d* in FIG. 2, a rear annular recess identical to the rear recess on each of the spacer discs, such as rear recess 55*d* as seen in FIG. 9, a central annual bore such as bore 56*d* in FIG. 9 and a tumbler wheel drive tab as tab 57*d* in FIG. 5, which cooperate with the coded webs of the key shank as discussed hereinafter. While the spacing of the false gates in the exemplary embodiment is 30°, such spacing could be less, such as 20°.

The array of tumbler wheels 50 and spacer discs 40, as seen in FIG. 9, are simply stacked one on the other in nested relation with the identical projections of each disc and wheel fitting into the mating and identically configured recesses of adjacent wheels or discs, as seen in FIG. 2, and with the assembly of springs 34 into the spacer disc slots 47*a* and 47*d*, and with the fence member 30 received in aligned tumbler wheel gates, the thus formed subassembly is merely slipped in to the cylinder 25. An assembly spacer wheel 60 is then inserted loosely within a wider internal annular notch 61 formed on an outer end of the cylinder and with bias spring 62 placed on the spacer wheel 60, the cylinder assembly in simply inserted into the lock body 21 and held therein by snapping snap ring 27 into the body groove 28. A simply assembled and effectively operating cylindrical type lock is thus provided. The spacer wheel 60 has a rounded periphery 63 to more easily slide in groove 61 under the bias of spring 62 which urges the stacked array of spacer discs and tumbler wheels into their desired nested, interfitting relationship as seen in FIG. 2. Wheel 60 has a central bore 64 to facilitate passage of the lock operating key which will now be discussed.

Figure 14:
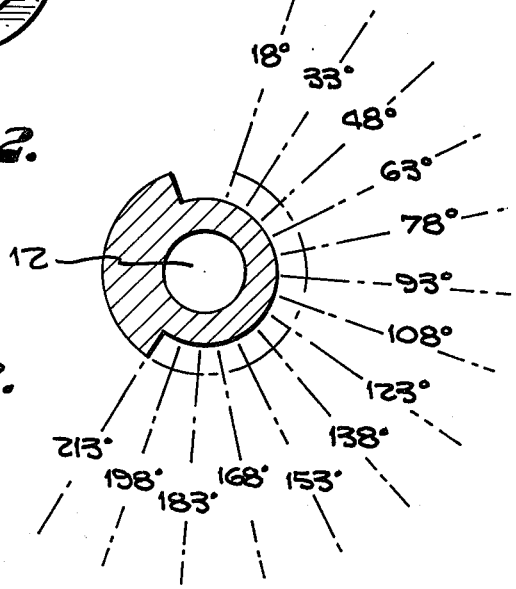
FIG. 14 is a schematic representation of the coding of the key shank tumbler wheels of the shank of FIG. 10.

As is also contemplated within the present invention in cylindrical lock and key, the exemplary embodiment of key is provided with a plurality of alternating coded webs 13 and blank webs 14. As best seen in FIG. 10, the exemplary key shank is provided with five coded webs 13*a* through 13*e*. The cross section configurations available for each of the coded webs 13, in accordance with the best invention, are illustrated somewhat schematically in FIG. 14 where various selectable sizes for the solid web section for each web are illustrated by the construction lines labeled by the number of degrees from vertical that a cutting tool would cut portions of the web away from the shank. The 18 degree construction line by way of example illustrates a web which extended all the way around the shank but for a cut-out segment of 18 degrees on either side of the vertical on the top of the shank as seen in FIG. 14. Continuous overlapping radial cuts can be made to produce a cut-out of any of the number of degrees indicated on the succeeding construction lines in FIG. 14, it being contemplated in this example that the cut-outs would vary between 18 degrees and 213 degrees as shown in FIG. 14. Other angles of cut and number of degrees per increment between cuts can be selected to produce different codes. The surface of the web facing the notch made by the selected web cut engages the inward projection, as projection 57*d* in FIG. 5, of an aligned tumbler wheel when the key shank is fully inserted as seen in FIG. 10 and rotated to manipulate the lock tumblers.

Figure 13:
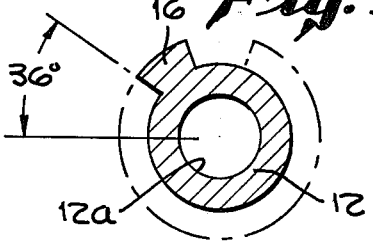
FIG. 13 is a section view of the key shank of FIG. 10 taken therein along the plane XIII—XIII.

The blank webs 14*a* through 14*g* are full angular webs but for the guide notch 17 which runs longitudinally along the upper portions of the shank through both the blank webs 14 and coded webs 13. As best seen in FIGS. 10, 11 and 12, and forward end of shank 12 is provided with a drive web 15 which is adapted to engage the key abutment 29 within cylinder 25 when the key has been rotated sufficient to cause the coded webs to move the tumbler wheels into proper alignment to place their respective gates in positions opening to and receiving the fence member 30. The extent of key rotation may be limited by a stop web 16 near the inner end of the web, web 16 may be configured to have a fairly small solid web section, as seen in the section view of FIG. 13 to limit turning movement of the key within the lock body.

Figure 8:
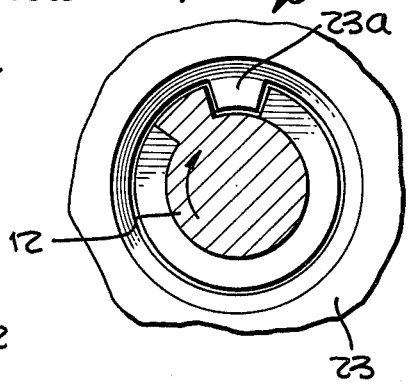
FIG. 8 is a view as in FIG. 7 showing the key shank fully rotated in a clockwise direction.

When the key shank is inserted into the central bore of the lock body, the cylinder guide post 25*a* will be received within the shank bore 12*a* to guide the shank centrally of the nested array of tumbler wheels 50 and spacer wheels 40. When the key shank is fully inserted, as seen in FIG. 10, the coded webs 13 are aligned to the tumbler wheels 50. By predetermining the location of the tumbler wheel true gates 53 relative to where the wheels will be turned through abutment between the coded webs and the wheel projections 57, the lock can be coded for a particular key to align the tumbler wheel true gates when the inserted key is turned sufficiently clockwise to bring the drive web 15 into engagement with the cylinder key abutment 29 to commence rotation of the cylinder within the lock body. On such relative rotation, fence member 30 will roll up ramp 24*a* provided on the cylinder and move into the aligned true gates of the tumbler wheels and gate notches 43 of the spacer discs. If the tumbler wheels are not properly aligned, the fence member 30 will wedge between the cylinder and lock body at ramp 24*a* preventing opening of the lock. Assuming that the tumbler wheels are properly aligned by having inserted and rotated the proper key, the cylinder will continue to rotate on turning of the key until the key is fully rotated to bring the stop web 16 into abutment with the lock body abutment 23*a* as best seen in FIG. 8. By this time, an associated latch is rotated sufficiently to unlock the associated safe door through connection between cylinder stud 26 and such associated lock actuator.

Having thus described a preferred exemplary embodiment of a cylinder type lock and key in accordance with the present invention, it should be understood by those skilled in the art that various additional advantages and objects of the present invention have been attained, that various modifications, adaptations and alternative embodiments may be made thereon, the present invention being defined by the following claims.

I claim:

1. In a cylindrical type lock having a rotatable cylinder within a lock body, said cylinder having a plurality of gated tumbler wheels rotatable therein, and a fence member interposed between said cylinder and body and moveable toward the gates of said tumbler wheels whereby rotation of said cylinder relative to said body is normally prevented unless said fence member is received into each of the gates of said tumbler wheels, the improvement comprising the provision of:

a stacked array of a plurality of nested and alternating tumbler wheels and spacer discs wherein said wheels and discs are each provided with identically configured annular projections on one side thereof and annular recesses on an opposite side thereof, said annular recesses being of sufficient size to receive a projection of an adjacent wheel or disc to place the same in a nested relation.

2. The improvement of claim 1 wherein:

said cylinder is provided with a longitudinal groove opening to one open end of the cylinder and said spacer discs each have a stop tab projecting radially outwardly thereof for a sliding fit into said groove on assembly of said discs and wheels to said cylinder in said stacked and nested, alternating array whereby said spacer discs are held stationary relative said wheels and cylinder.

3. The improvement in claims 1 or 2 wherein:

said cylinder has an annular internal groove at a forward end thereof;

an end disc is provided in axially movable relation to said cylinder with peripheral portions thereof being confined in said internal groove, said end disc being located adjacent a forward end of said array of tumbler wheels and spacer discs; and biasing means for biasing said end disc toward said array.

4. The improvement in a cylinder type lock of claim 2 wherein said lock body is provided with a rear end internal snap ring receiving groove and comprising:

a snap ring provided in said snap ring receiving groove of said body to hold said cylinder in said body whereby said tumbler wheels, spacer discs and cylinder may be preassembled to each other and inserted as a subassembly into said lock body to the held thereby said snap ring.

5. The improvement in cylinder type lock of claim 1 wherein:

said fence member is a cylindrical pin, biasing means comprising one or more spring is provided to normally bias said pin away from said wheels, said cylinder has a longitudinal fence pin receiving groove with spring receiving slots and one or more of said spacer discs have spring receiving slots.

6. The improvement in cylinder type lock of claim 1 wherein said spacer discs and tumbler wheels have key receiving center bores with key abutments on each thereof projecting into the associated bore, the improvement comprising the provision of an operating key comprising:

a key shank having a plurality of alternating and spaced blank and coded webs, said coded webs having coded abutment surfaces to engage said tumbler wheel key abutments.

7. The improvement in cylinder type lock of claim 6 wherein:

said blank webs have aligned guide notches to receive passage of said tumbler wheel projections thereby on insertion of said key, said blank webs being otherwise of generally planar ring configuration.

8. The improvement in cylinder type lock of claim 7 wherein:

said coded webs are of planar ring section configuration, the circumferential extent of said sections varying to provide a coding for said key.

* * * * *